US011352846B2

(12) United States Patent
Vick, Jr.

(10) Patent No.: US 11,352,846 B2
(45) Date of Patent: Jun. 7, 2022

(54) ADVANCED PULLING PRONG

(71) Applicant: Halliburton Energy Services, Inc., Houston, TX (US)

(72) Inventor: James Dan Vick, Jr., Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/566,467

(22) Filed: Sep. 10, 2019

(65) Prior Publication Data

US 2020/0190929 A1 Jun. 18, 2020

(51) Int. Cl.

| | |
|---|---|
| ***E21B 23/04*** | (2006.01) |
| ***E21B 23/00*** | (2006.01) |
| ***E21B 31/12*** | (2006.01) |
| ***E21B 31/20*** | (2006.01) |

(52) U.S. Cl.

CPC ..... *E21B 23/0412* (2020.05); *E21B 23/00* (2013.01); *E21B 23/04* (2013.01); *E21B 31/12* (2013.01); *E21B 31/20* (2013.01)

(58) Field of Classification Search

CPC ..... E21B 23/0412; E21B 23/04; E21B 23/00; E21B 31/12; E21B 31/20

See application file for complete search history.

(56) References Cited

U.S. PATENT DOCUMENTS

| | | | | |
|---|---|---|---|---|
| 5,228,507 | A | 7/1993 | Obrejanu et al. | |
| 5,526,888 | A | 6/1996 | Gazewood | |
| 5,775,433 | A * | 7/1998 | Hammett | E21B 17/06 166/381 |
| 5,988,277 | A | 11/1999 | Vick, Jr. et al. | |
| 6,003,606 | A | 12/1999 | Moore et al. | |
| 6,286,592 | B1 | 9/2001 | Moore et al. | |
| 7,051,810 | B2 | 5/2006 | Clemens et al. | |
| 7,467,661 | B2 * | 12/2008 | Gordon | E21B 43/112 166/298 |
| 7,934,561 | B2 * | 5/2011 | Ormond | F15B 1/24 166/355 |
| 10,018,006 | B2 * | 7/2018 | Motland | E21B 23/03 |
| 2009/0283329 | A1 | 11/2009 | Able et al. | |
| 2012/0118560 | A1 | 5/2012 | Mikalsen et al. | |
| 2014/0311757 | A1 * | 10/2014 | Hallundbæk et al. | E21B 31/20 166/383 |

* cited by examiner

*Primary Examiner* — D. Andrews
*Assistant Examiner* — Jonathan Malikasim
(74) *Attorney, Agent, or Firm* — Scott Richardson; Parker Justiss, P.C.

(57) ABSTRACT

Provided, in one embodiment, is a pulling prong. The pulling prong, in one example, includes an outer housing, and a nose assembly slidably located within the outer housing. In this example, the nose assembly and outer housing form an activation chamber. The pulling prong, in this example, may further include activation means located within the activation chamber, the activation means configured to move the nose assembly from a first running configuration to a second retrieving configuration.

9 Claims, 6 Drawing Sheets

100

160
105
130
110
125
160
145
155
135
195
140
120
190
185
180
150
170
175
115
165

ADVANCED PULLING PRONG

CROSS-REFERENCE TO RELATED APPLICATION

This application claims priority to International Application Serial No. PCT/US2018/066212, filed on Dec. 18, 2018, and entitled "ADVANCED PULLING PRONG," is commonly assigned with this application and incorporated herein by reference in its entirety.

BACKGROUND

After drilling a well that intersects a subterranean hydrocarbon bearing reservoir, a variety of well tools are often positioned in the wellbore during completion, production or remedial activities. For example, temporary packers are often set in the wellbore during the completion and production operating phases of the well. In addition, various operating tools including flow controllers such as plugs, chokes, valves and the like, and safety devices such as safety valves, are often releasably positioned in the wellbore.

In the event that one of these well tools that has been previously placed within the wellbore requires removal, a pulling tool attached to a conveyance, such as a wireline, slickline, coiled tubing or the like, is typically run downhole to the location of the well tool to be removed. The pulling tool, which may include latching assembly and a pulling prong, is latched to a fishing neck on the well tool previously placed into the wellbore. Thereafter, the well tool can be dislodged from the wellbore and retrieved to the surface.

It has been found, however, the once a well tool has been positioned within the wellbore, the well tool may become difficult to retrieve. In addition, even normal retrieval operations may place significant demands on the integrity and strength of the pulling tool and conveyance in wells that are deep, deviated, inclined or horizontal due to elongation of the conveyance and added frictional effects. Accordingly, what is needed in the art is an improved pulling prong that does not encounter the drawbacks of existing pulling tools.

BRIEF DESCRIPTION

Reference is now made to the following descriptions taken in conjunction with the accompanying drawings, in which.

DETAILED DESCRIPTION

Figure 1:
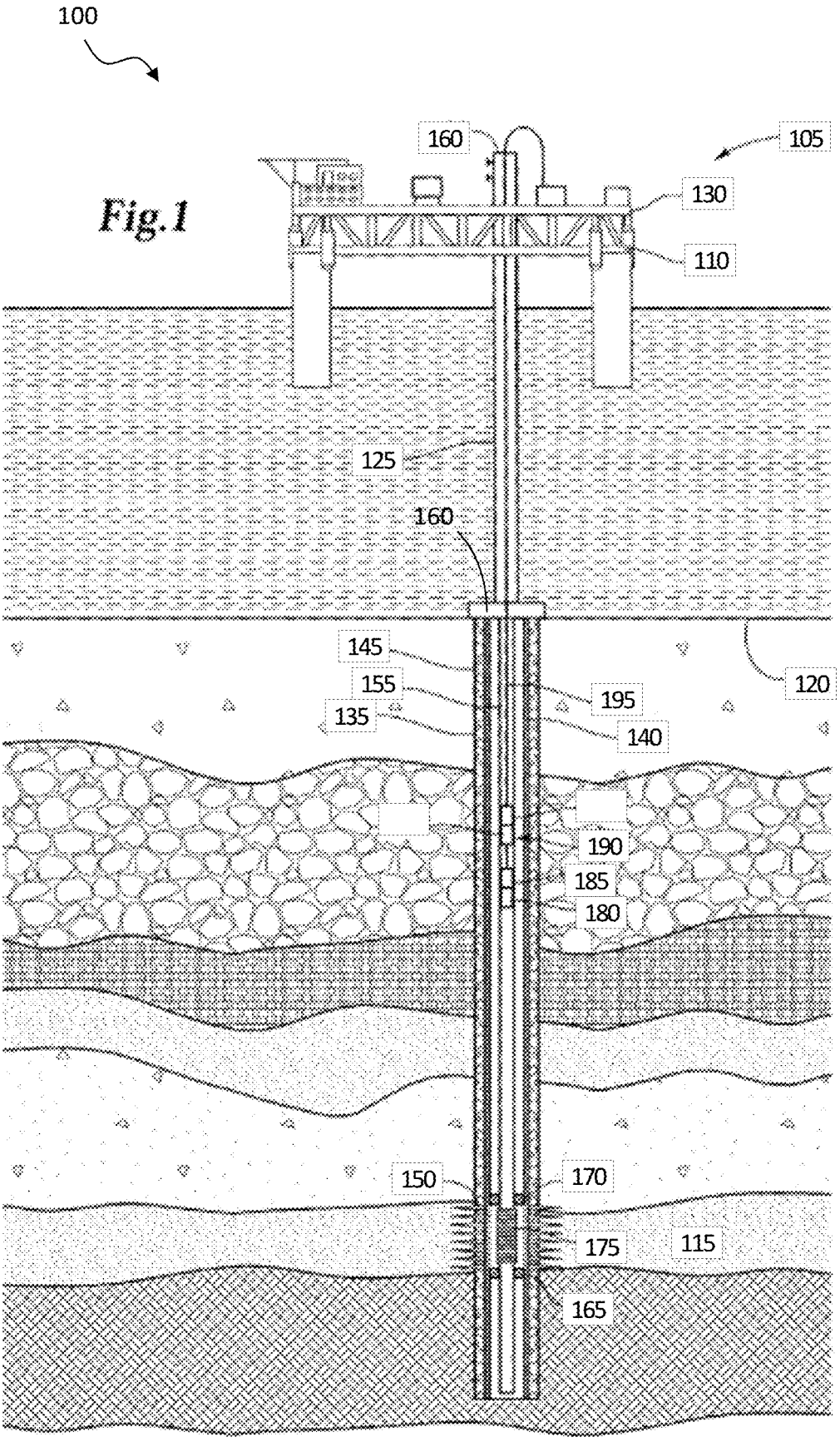
FIG. 1 illustrates an oil/gas well system including a pulling tool, which may include a pulling prong according to the present disclosure.

Referring initially to FIG. 1, illustrated is an oil/gas well system 100 including a pulling tool 190, which may include a pulling prong according to the present disclosure. The oil/gas well system 100 includes an offshore oil and gas platform that is schematically illustrated and generally designated 105. A semi-submersible platform 110 is centered over a submerged oil and gas formation 115 located below sea floor 120. A subsea conductor 125 extends from deck 130 of platform 110 to sea floor 120. A wellbore 135 extends from sea floor 120 and traverses formation 115. Wellbore 135 includes a casing 140 that is cemented therein by cement 145. Casing 140 has perforations 150 in an interval proximate formation 115.

A tubing string 155 extends from wellhead 160 to formation 115 to provide a conduit for production fluids to travel to the surface. A pair of packers 165, 170, in one embodiment, provide a fluid seal between tubing string 155 and casing 140 and direct the flow of production fluids from formation 115 through sand control screen 175. Disposed within tubing string 155 is a well tool 180 such as a wireline retrievable subsurface safety valve that is designed to shut in the flow of production fluids if certain out of range conditions occur. The well tool 180, in the embodiment shown, is coupled to a lock mandrel 185. The lock mandrel 185, in this embodiment, employs a lock mandrel profile to engage a profile in a landing nipple of the tubing string 155, and thus removably fix the well tool 180 within the tubing string 155.

In the illustrated embodiment, a retrieving/pulling operation is being conducted wherein a pulling tool 190 is being run downhole on a conveyance 195. The conveyance 195, in certain embodiments, is a wireline, a slickline, an electric line, a coiled tubing or a jointed tubing or the like. As explained in greater detail below, the pulling tool 190 may employ a pulling prong (not shown in FIG. 1) designed and manufactured according to the present disclosure to assist in disengaging the lock mandrel 185 from the tubing string 155, and thus allow the well tool 180 to be retrieved from the wellbore 135. The pulling prong, in certain embodiments, is additionally configured to help extend the lock mandrel 185 (e.g., keeping the lock mandrel profile continuously retracted) as it is being retrieved.

Even though FIG. 1 depicts a vertical well, it should be noted by one skilled in the art that the pulling tool of the present disclosure is equally well-suited for use in deviated wells, inclined wells or horizontal wells. Also, even though FIG. 1 depicts an offshore operation, it should be noted by one skilled in the art that the pulling tool of the present disclosure is equally well-suited for use in onshore operations.

Figure 2:
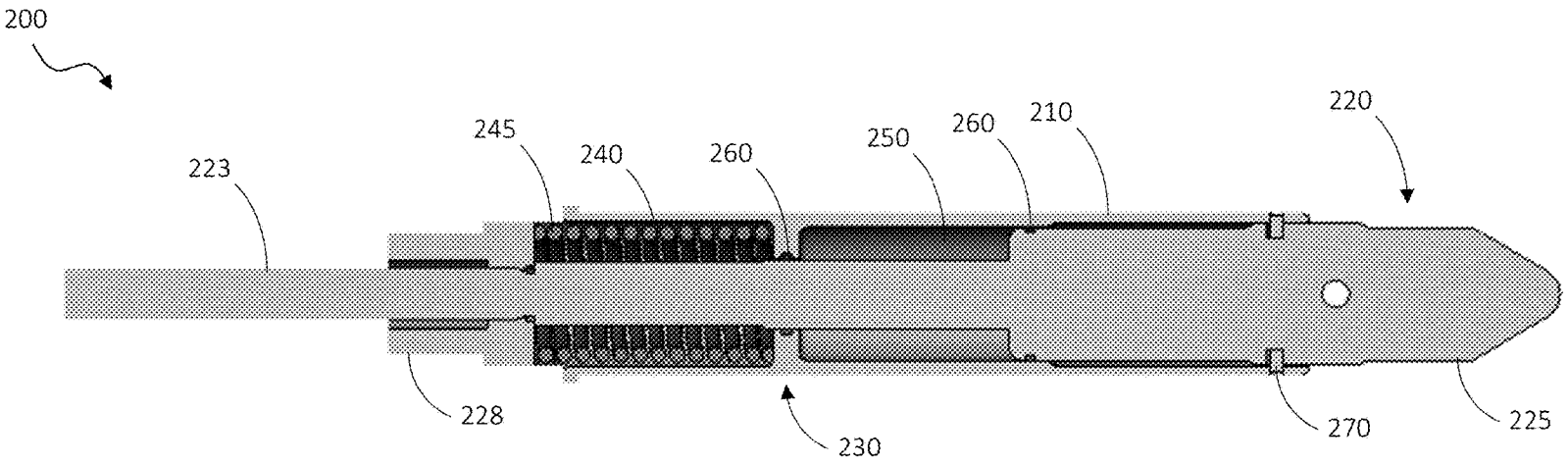
FIG. 2 illustrates one embodiment of a pulling prong manufactured according to the disclosure.

Turning to FIG. 2, illustrated is one embodiment of a pulling prong 200 manufactured according to the disclosure. The pulling prong 200 initially includes an outer housing 210. The outer housing 210, in one embodiment, comprises a rigid material, such as metal or the like. The outer housing 210, in the illustrated embodiment, creates an inner radial bore.

The pulling prong 200, in the illustrated embodiment, further includes a nose assembly 220 slidably located within the outer housing 210. The nose assembly 220, as shown, may include a post portion 223, a nose portion 225 located proximate one end of the post portion 223, and an engagement portion 228 located proximate an opposing end of the post portion 223. The engaged portion 228, in the embodiment shown, is fixed to the post portion 223. Accordingly, a distance between the engagement portion 228 and the nose portion 225 is substantially fixed. The nose assembly 220, in certain of the embodiments, is configured to slide within one or more reduced diameter bores in the outer housing 210. While not shown, the nose assembly 220 may additionally include an end connection with a prong extension. For example, a rod (e.g., plastic rod in one embodiment) could be attached to the downhole end of the nose assembly 220 to prop open a flapper on an insert valve, among other uses.

In accordance with one aspect of the disclosure, the nose assembly 220 and outer housing 210 form an activation chamber 230. The activation chamber 230 may include one or more different types of activation means and remain within the purview of the disclosure. For example, the activation chamber 230 might include one or more springs as the activation means. Those skilled in the art understand the different types of springs, including linear coil springs, which might be used. Alternatively, the activation chamber 230 might employ a pressure differential between the activation chamber 230 and outside the outer housing 210 as the activation means. For instance, if the activation chamber were held at a low pressure (e.g., substantially atmospheric pressure) while the outer housing 210 were subjected to a much higher pressure, the much higher pressure could act upon the nose assembly to activate the activation chamber 230.

The activation chamber 230, in one embodiment, may be broken into a plurality of smaller activation chambers. For example, as shown in FIG. 2, the activation chamber 230 includes a first spring chamber 240 and a second pressure chamber 250. In this embodiment, the first spring chamber 240 could include a spring member 245, while the second pressure chamber 250 could include the aforementioned lower pressure. In the illustrated embodiment, the pulling prong 200 is in a first running configuration, as might be seen when the pulling prong 200 is running into the wellbore. In this first running configuration, the spring member 245 is in a compressed state and the pressure chamber 250 is in an extended state. Alternatively, when the pulling prong 200 is in a second retrieving configuration, the spring member 245 could be in an extended state and the pressure chamber 250 could be in a compressed state.

As is illustrated in FIG. 2, one or more seals 260 may be used to create the pressure chamber 250. The one or more seals 260 may comprise any seal configured for use in an oil and gas well system and remain within the scope of the disclosure. In the embodiment of FIG. 2, the one or more seals are placed between the nose portion 225 of the nose assembly 220 and an inner diameter of the outer housing 210. Furthermore, one or more seals may be placed between the reduced diameter bore of the outer housing 210 and the post portion 223 of the nose assembly 220. Thus, in one embodiment, the pressure chamber 250 may be maintained at a fixed pressure (e.g., atmospheric pressure), while the outer housing 210 is disposed downhole at a much higher pressure.

The pulling prong 200 has been illustrated and discussed in FIG. 2 as containing both the first spring chamber 240 and the second pressure chamber 250. While certain embodiments may employ both the first spring chamber 240 and the second pressure chamber 250, other embodiments may just employ a single activation chamber. For example, certain embodiments exist wherein the activation chamber 230 comprises only a single spring chamber 240, whereas other embodiments exist wherein the pressure chamber 230 comprises only a single pressure chamber 240. Notwithstanding, the present disclosure should not be limited to any specific configuration.

The pulling prong 200 of FIG. 2 additionally includes a securing structure 270. The securing structure 270, in one embodiment, is positioned between the nose assembly 220 and the outer housing 210. In this configuration, the securing structure 270 is designed to maintain the nose assembly 220 in the first running configuration when running downhole, and then adjust to allow the nose assembly 220 to move to the second retrieving configuration when moving uphole. In one example, the securing structure 270 is a collection of one or more shear pins. In this example, the one or more shear pins can maintain the nose assembly 220 in the first running configuration, and when needed the one or more shear pins may shear, and thus allow the actuation means to move the nose assembly 220 to the second retrieving configuration. Those skilled in the art understand the myriad of different ways one might shear the one or more shear pins, including using a jar or other similar device.

Figure 3:
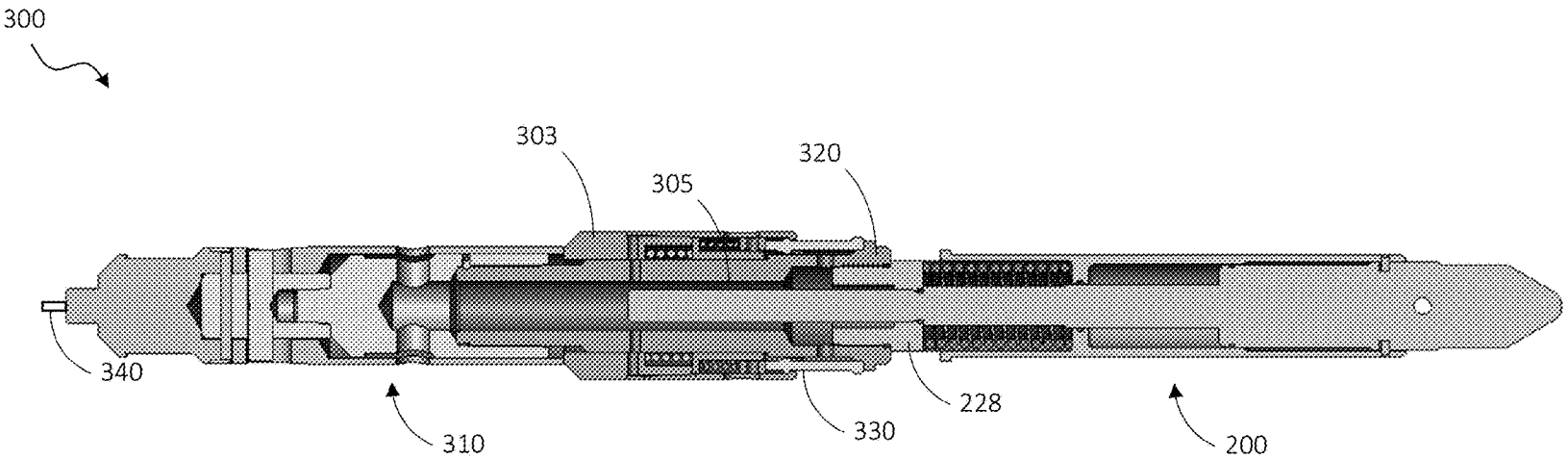
FIG. 3 illustrates one embodiment of a pulling tool manufactured according to the disclosure.

Turning to FIG. 3, illustrated is one embodiment of a pulling tool 300 manufactured according to the disclosure. The pulling tool 300, in this embodiment, includes a latching assembly 310 coupled on an uphole end of the pulling prong 200. In the embodiment shown, a latching tool engagement portion 320 fixedly engages the engagement portion 228 of the nose assembly 220. In one embodiment, the engagement portion 228 screws into the latching tool engagement portion 320. Notwithstanding, other attachment mechanisms are within the scope of the present disclosure. Accordingly, the latching assembly 310 and pulling prong 200 are engaged with one another for deployment downhole.

The latching assembly 310, in the embodiment shown, includes a latch assembly housing 303, a central aperture 305 defined by the latch assembly housing 303, and a latch member 330. The latch member 330, which may comprise a variety of different structures (e.g., including the latching ear shown) is configured to engage a corresponding latch structure (not shown) in a lock mandrel. The latching assembly 310, as illustrated, may be coupled to a conveyance 340. The conveyance 340, in certain embodiments, is a wireline, a slickline, an electric line, a coiled tubing or a jointed tubing or the like.

The lock mandrel 430 additionally includes one or more lock mandrel profiles 450. The lock mandrel profiles 450, in one embodiment, are configured to radially extend and retract as the lock mandrel is actuated. In the illustrated embodiment of FIG. 4A, the lock mandrel profiles 450 are radially extended into the tubing profile 425, such that the lock mandrel 430 is an engaged state. As will be further understood below, the pulling tool 300 may be used to move the lock mandrel 430 into a disengaged state, and thus radially retract the one or more lock mandrel profiles 450 away from the tubing profile 425.

Figure 4A:
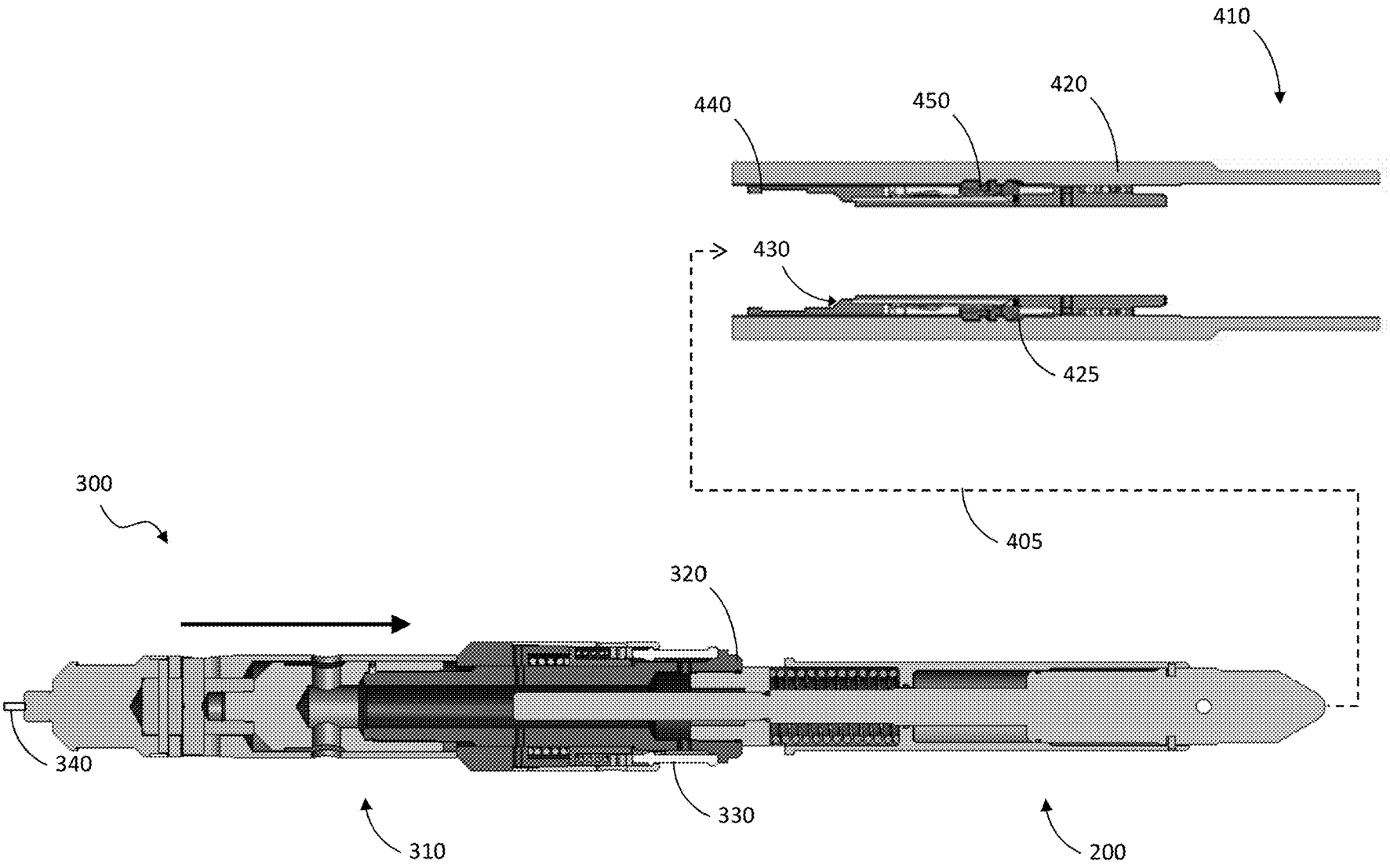
FIGS. 4A-4D illustrate various views of the pulling tool, including a latching assembly and a pulling prong, manufactured according to the disclosure, at different states while retrieving a well tool from a wellbore.

The tubing 410, in the illustrated embodiment, includes a landing nipple 420. The landing nipple 420, in the illustrated embodiment, includes a tubing profile 425. The tubing profile 425, in one example embodiment, is located on an interior surface of the landing nipple 420, and is configured to engage one or more related profiles. Positioned within the tubing 410, in the embodiment of FIG. 4A, is a lock mandrel 430. While many different lock mandrels may be used and remain within the purview of the present disclosure, the lock mandrel 430 of FIG. 4A includes a latch structure 440. The latch structure 440, as will be further understood below, is configured to engage with the latch member 330 of the latching assembly 310.

The lock mandrel 430 additionally includes one or more lock mandrel profiles 450. The lock mandrel profiles 450, in one embodiment, are configured to radially extend and retract as the lock mandrel is actuated. In the illustrated embodiment of FIG. 4A, the lock mandrel profiles 450 are radially extended into the tubing profile 435, such that the lock mandrel 430 is an engaged state. As will be further understood below, the pulling tool 300 may be used to move the lock mandrel 430 into a disengaged state, and thus radially retract the one or more lock mandrel profiles 450 away from the tubing profile 425.

While not shown, the lock mandrel 430 may additionally be engaged with one or more well tools. For example, one or more well tools could be attached to a downhole side of the lock mandrel 430. Those skilled in the art understand the myriad of different well tools that might couple (e.g., directly or indirectly) to the lock mandrel 430 and remain within the scope of the present disclosure.

Figure 4B:
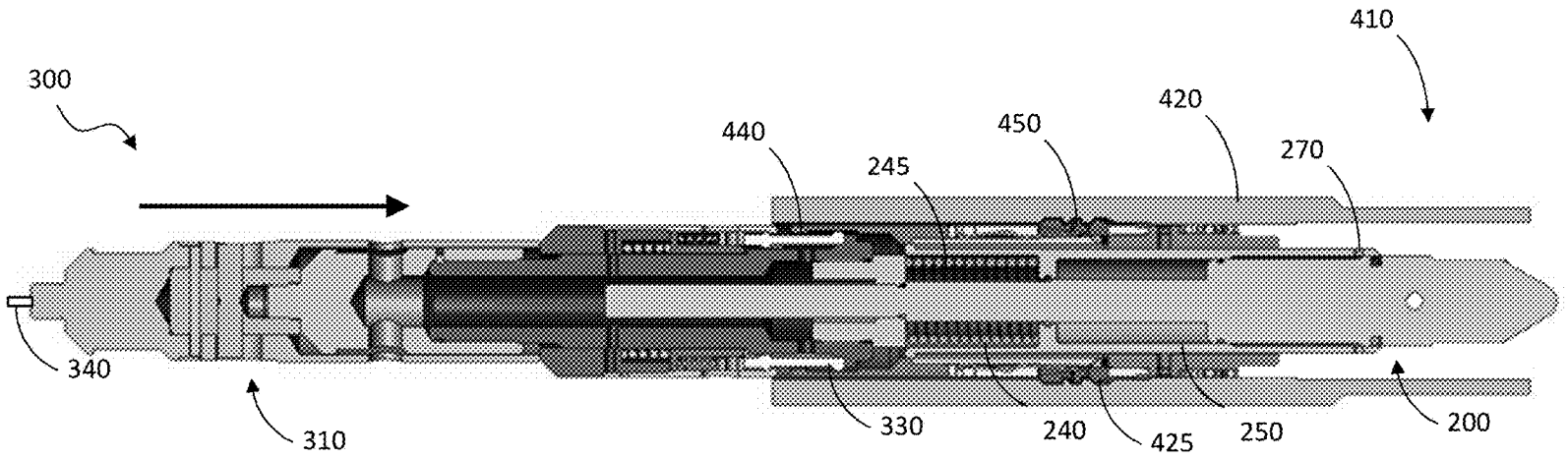

Turning now to FIG. 4B, the pulling tool 300 has engaged the lock mandrel 430, and thus the tubing 410. In this instance, the latch member 330 of the latching assembly 310 has slid past and engaged the latch structure 440. Accordingly, at this juncture, the pulling tool 300 and the lock mandrel 430 are engaged with one another. In accordance with the disclosure, additional downward pressure on the pulling tool 300, or a jarring motion, could shear the securing structures 270. Additionally, one could pressurize the well to shear the securing structures 270. FIG. 4B illustrates the securing structures 270 having just been sheared.

Figure 4C:
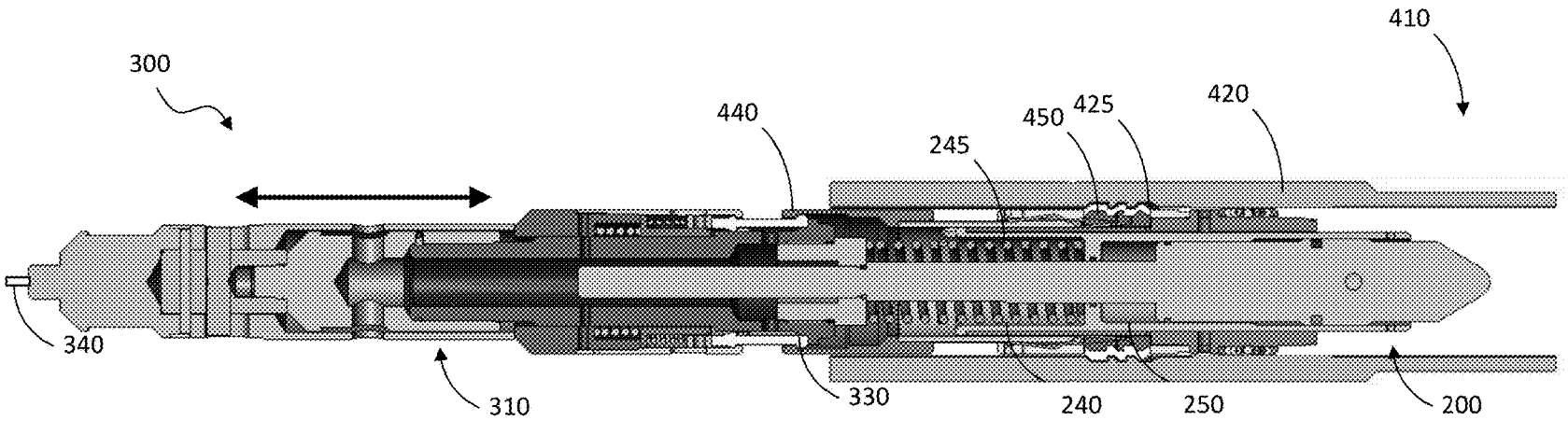

Turning to FIG. 4C, as the securing structures 270 shear, the activation means in the activation chamber react. In the illustrated embodiment, the spring member 245 located in the spring chamber 240 moves to an extended state, and the differential in pressure between the pressure chamber 250 and the outer housing 210 moves the pressure chamber 250 to a compressed state. Accordingly, as shown, the latch member 330 pulls the latch structure 440 axially uphole, and thus moves the lock mandrel 430 into a disengaged state. For example, this may occur by "stretching" the lock mandrel 430. When the lock mandrel 430 is in the disengaged state, which in this embodiment occurs by shifting an uphole portion of the lock mandrel 430 relative to a downhole portion of the lock mandrel 430, the one or more lock mandrel profiles 450 radially retract away from the tubing profile 425. With the one or more lock mandrel profiles 450 no longer engaged with the tubing profile 425, the lock mandrel 430 is no longer fixed in the tubing 410.

The pulling tool 300 has been illustrated and discussed with regard to FIG. 4C as using the activation means in the activation chamber to radially retract the lock mandrel profiles 450. In certain embodiments, the pulling prong 200 can function as typical solid prong, and thus the activation means and the activation chamber are not employed. For example, in those situations where there is little difficulty pulling the lock mandrel 430, simply pulling up on the conveyance 430 may stretch the lock mandrel 430 and thus radially retract the lock mandrel profiles 450. However, if there is difficulty in pulling the lock mandrel 430, the activation means and activation chamber may be used.

Figure 4D:
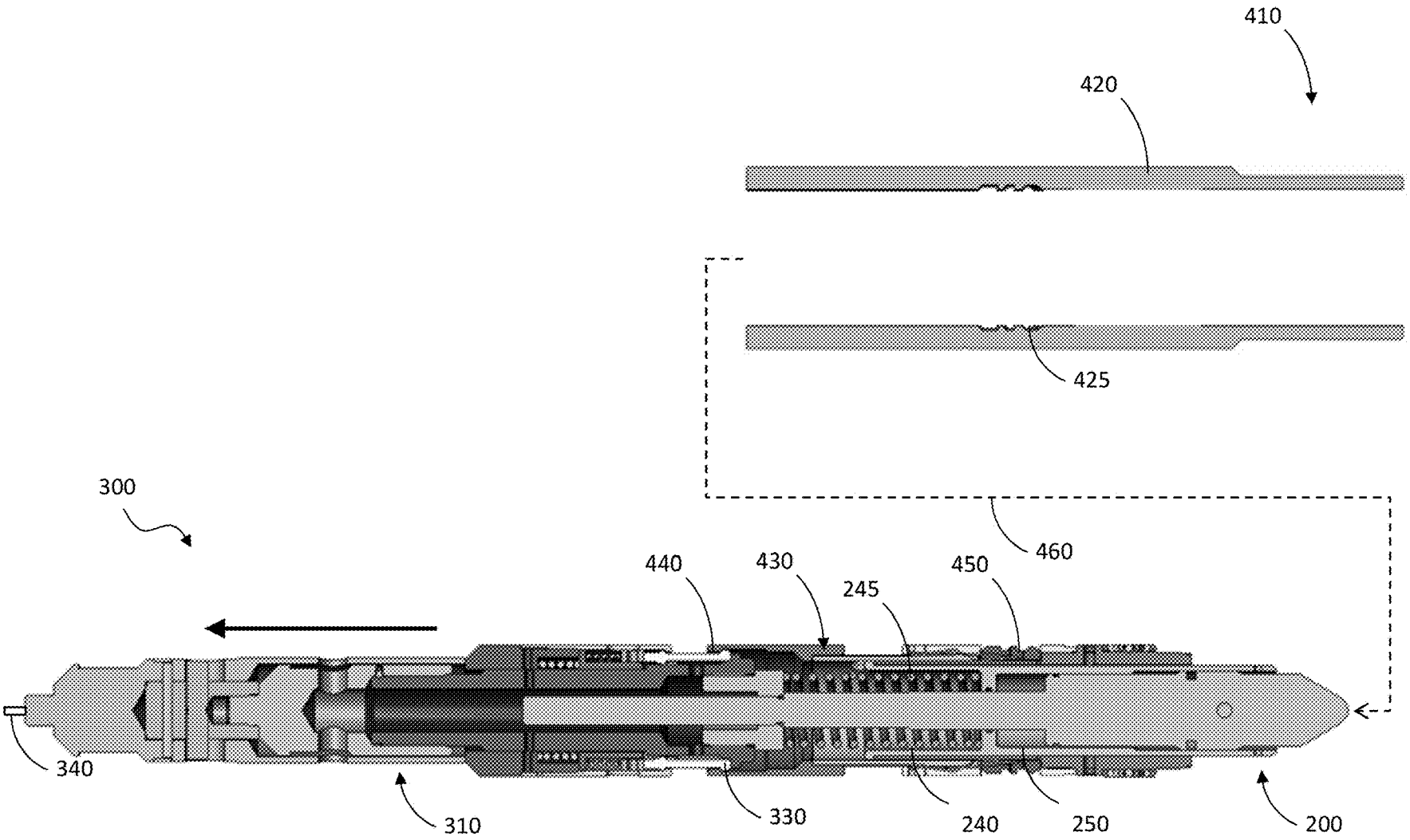

Turning finally to FIG. 4D, the pulling tool 300, which is still attached to the lock mandrel 430, may be withdrawn uphole, as illustrated by the dotted line 460. The lock mandrel 430, in one embodiment, may remain within the disengaged state an entire time the lock mandrel 430 is being withdrawn from the wellbore. For instance, since the pulling prong 200 has been activated, and thus the nose assembly 220 is in the second retrieving configuration, the lock mandrel 430 is kept in the disengaged state. As the lock mandrel 430 is kept in the disengaged state, the lock mandrel profiles 450 are radially retracted, and thus will not likely catch upon other features in the wellbore as the pulling tool 300 is being withdrawn uphole.

Figure 5:
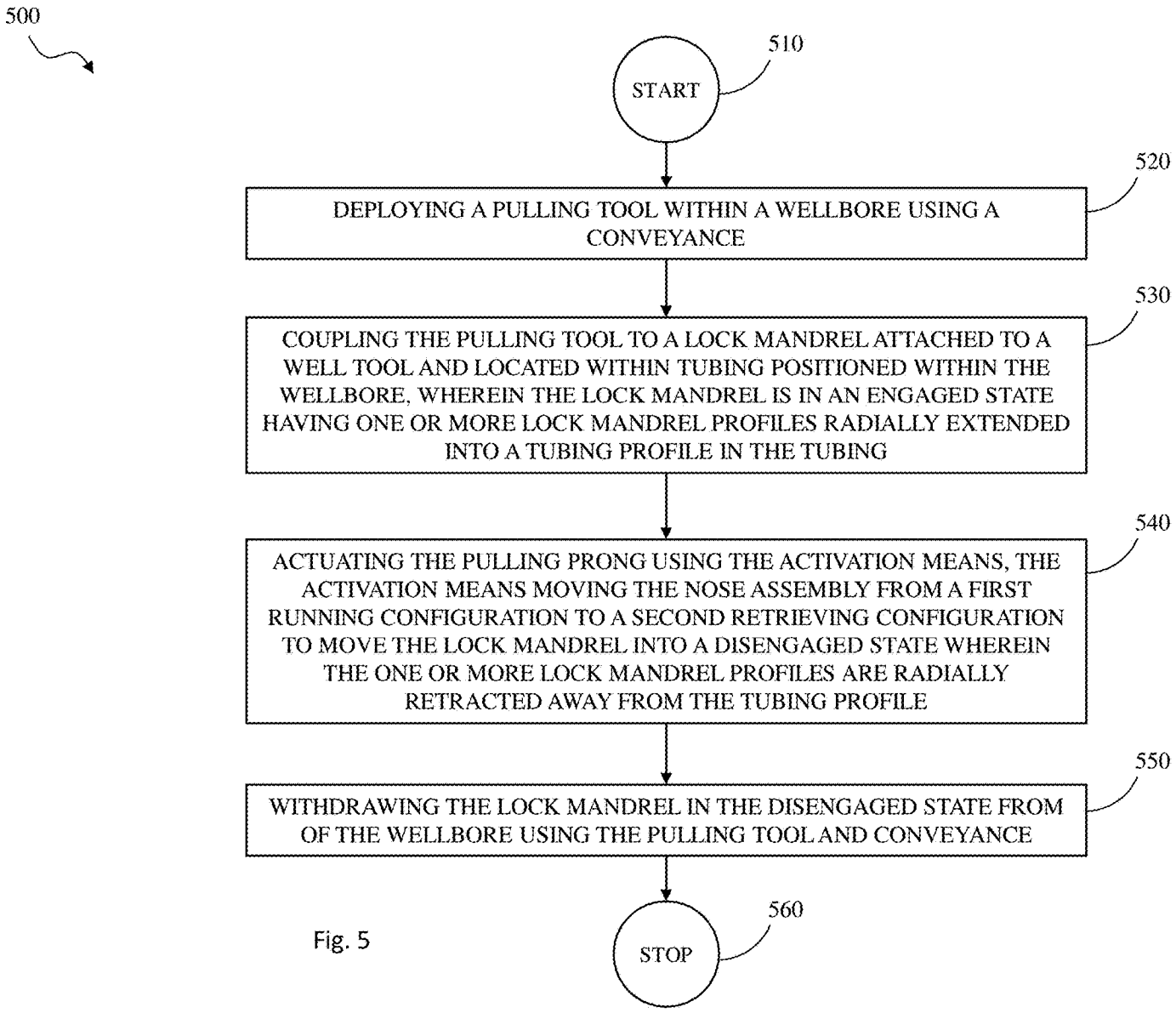
FIG. 5 illustrates a flow diagram depicting one method for retrieving a well tool.

Turning now to FIG. 5, illustrated is a flow diagram 500 illustrating one method for retrieving a well tool. The method begins in a start step 510. The method continues in a step 520, by deploying a pulling tool within a wellbore using a conveyance. The pulling tool, in this embodiment, includes a latching assembly, and a pulling prong coupled to the latching assembly. The pulling prong, in this embodiment, includes an outer housing, a nose assembly slidably located within the outer housing, the nose assembly and outer housing forming an activation chamber, and activation means located within the activation chamber, the activation means configured to move the nose assembly from a first running configuration to a second retrieving configuration.

Thereafter, the method continues in a step 530 by coupling the pulling tool to a lock mandrel attached to a well tool and located within tubing positioned within the wellbore, wherein the lock mandrel is in an engaged state having one or more lock mandrel profiles radially extended into a tubing profile in the tubing. After coupling the pulling tool to the lock mandrel, the method continues in a step 540 by actuating the pulling prong using the activation means, the activation means moving the nose assembly from a first running configuration to a second retrieving configuration to move the lock mandrel into a disengaged state wherein the one or more lock mandrel profiles are radially retracted away from the tubing profile. The method may continue in a step 550, for example by withdrawing the lock mandrel in the disengaged state from of the wellbore using the pulling tool and conveyance. The method may then commence in a stop step 560.

Aspects Disclosed Herein Include:

A. A pulling prong. The pulling prong includes: an outer housing; a nose assembly slidably located within the outer housing, the nose assembly and outer housing forming an activation chamber; and activation means located within the activation chamber, the activation means configured to move the nose assembly from a first running configuration to a second retrieving configuration.

B. A method for retrieving a well tool. The method includes: deploying a pulling tool within a wellbore using a conveyance, the pulling tool including a latching assembly and a pulling prong coupled to the latching assembly, wherein the pulling prong includes 1) an outer housing, 2) a nose assembly slidably located within the outer housing, the nose assembly and outer housing forming an activation chamber, and 3) activation means located within the activation chamber, the activation means configured to move the nose assembly from a first running configuration to a second retrieving configuration; coupling the pulling tool to a lock mandrel attached to a well tool and located within tubing positioned within the wellbore, wherein the lock mandrel is in an engaged state having one or more lock mandrel profiles radially extended into a tubing profile in the tubing; actuating the pulling prong using the activation means, the activation means moving the nose assembly from a first running configuration to a second retrieving configuration to move the lock mandrel into a disengaged state wherein the one or more lock mandrel profiles are radially retracted away from the tubing profile; and withdrawing the lock mandrel in the disengaged state from of the wellbore using the pulling tool and conveyance.

Aspects A and B may have one or more of the following additional elements in combination:

Element 1: wherein the activation chamber is a spring chamber and the activation means is a spring member. Element 2: wherein the spring member is configured to be in a compressed state when the nose assembly is in the first running configuration and in an extended state when the nose assembly is in the second retrieving configuration. Element 3: wherein the activation chamber is a pressure chamber and the activation means is a differential in pressure between the pressure chamber and downhole pressure surrounding the pulling prong. Element 4: wherein one or more seals are located between the outer housing and the nose assembly, and further wherein the pressure chamber is an atmospheric pressure chamber. Element 5: wherein the pressure chamber is configured to be in an extended state when the nose assembly is in the first running configuration and in a compressed state when the nose assembly is in the second retrieving configuration. Element 6: wherein the activation chamber includes a first spring chamber and a second pressure chamber, and further wherein the activation means includes a spring member located within the first spring chamber and a pressure differential located within the second pressure chamber, and further wherein the spring member is configured to be in a first compressed state and the pressure chamber is configured to be in a first extended state when the nose assembly is in the first running configuration, and the spring member is configured to be in a second extended state and the pressure chamber is configured to be in a second compressed state when the nose assembly is in the second retrieving configuration. Element 7: wherein the nose assembly includes a post portion, a nose portion located proximate one end of the post portion and an engagement portion located proximate an opposing end of the post portion. Element 8: further including a securing structure positioned between the nose assembly and the outer housing. Element 9: wherein the securing structure is a collection of one or more shear pins. Element 10: wherein the pulling prong keeps the lock mandrel in the disengaged state an entire time the lock mandrel is being withdrawn from the wellbore. Element 12: further including a collection of one or more shear pins positioned between the nose assembly and the inner radial bore to keep the nose assembly in the first running configuration while deploying the pulling tool, and further including actuating the pulling prong using the activation means by shearing the one or more shear pins.

Those skilled in the art to which this application relates will appreciate that other and further additions, deletions, substitutions and modifications may be made to the described embodiments.

What is claimed is:

1. A pulling tool, comprising:

a latching assembly, the latching assembly including:

a latch assembly housing having an engagement end, the latch assembly housing defining a central aperture; and a latch member coupled to the latch assembly housing, the latch member operable to move between a radially extended state and a radially retracted state; and a pulling prong coupled to the latching assembly, the pulling prong including;

an outer housing;

a nose assembly slidably located within the outer housing, the nose assembly including a post portion that extends at least partially within the central aperture of the latch assembly housing, a nose portion located proximate one end of the post portion and an engagement portion located proximate an opposing end of the post portion, the engagement portion engaged with the engagement end of the latch assembly housing, the nose assembly and outer housing forming an activation chamber; and activation means located within the activation chamber, the activation means configured to move the nose assembly from a first running configuration to a second retrieving configuration.

2. The pulling tool as recited in claim 1, wherein the activation chamber is a spring chamber and the activation means is a spring member.

3. The pulling tool as recited in claim 2, wherein the spring member is configured to be in a compressed state when the nose assembly is in the first running configuration and in an extended state when the nose assembly is in the second retrieving configuration.

4. The pulling tool as recited in claim 1, wherein the activation chamber is a pressure chamber and the activation means is a differential in pressure between the pressure chamber and downhole pressure surrounding the pulling prong.

5. The pulling tool as recited in claim 4, wherein one or more seals are located between the outer housing and the nose assembly, and further wherein the pressure chamber is an atmospheric pressure chamber.

6. The pulling tool as recited in claim 5, wherein the pressure chamber is configured to be in an extended state when the nose assembly is in the first running configuration and in a compressed state when the nose assembly is in the second retrieving configuration.

7. The pulling tool as recited in claim 1, wherein the activation chamber includes a first spring chamber and a second pressure chamber, and further wherein the activation means includes a spring member located within the first spring chamber and a pressure differential between an inside and an outside of the second pressure chamber, and further wherein the spring member is configured to be in a first compressed state and the pressure chamber is configured to be in a first extended state when the nose assembly is in the first running configuration, and the spring member is configured to be in a second extended state and the pressure chamber is configured to be in a second compressed state when the nose assembly is in the second retrieving configuration.

8. The pulling tool as recited in claim 1, further including a securing structure positioned between the nose assembly and the outer housing.

9. The pulling tool as recited in claim 8, wherein the securing structure is a collection of one or more shear pins.

* * * * *